United States Patent [19]

Jaquay et al.

[11] 4,439,307

[45] Mar. 27, 1984

[54] HEATING PROCESS GAS FOR INDIRECT SHALE OIL RETORTING THROUGH THE COMBUSTION OF RESIDUAL CARBON IN OIL DEPLETED SHALE

[75] Inventors: Louis H. Jaquay, Upper St. Clair, Pa.; Albert C. Mengon, deceased, late of Beaver, Pa., by Mary A. Mengon, administratrix

[73] Assignee: Dravo Corporation, Pittsburgh, Pa.

[21] Appl. No.: 510,290

[22] Filed: Jul. 1, 1983

[51] Int. Cl.[3] ..... C10G 1/02; C10B 49/02; C10B 53/06

[52] U.S. Cl. ..... 208/11 R; 201/29; 201/34; 201/13

[58] Field of Search ..... 208/11 R; 201/13, 14, 201/28, 29, 32, 34, 37, 40

[56] References Cited

U.S. PATENT DOCUMENTS

| | | | |
|---|---|---|---|
| 2,752,292 | 6/1956 | Scott, Jr. | 201/29 X |
| 2,814,587 | 11/1957 | Van Dijck | 208/11 R |
| 2,982,701 | 5/1961 | Scott, Jr. | 208/11 R |
| 3,318,798 | 5/1967 | Kondis et al. | 201/34 X |
| 3,331,754 | 7/1967 | Mansfield | 201/28 |
| 3,384,569 | 5/1968 | Peet | 208/11 R |
| 3,503,869 | 3/1970 | Haddad et al. | 201/29 X |
| 3,517,468 | 11/1971 | Reyburn et al. | 208/11 P |
| 3,520,795 | 7/1970 | Schulman et al. | 201/29 X |
| 3,526,586 | 9/1970 | Saxton | 208/11 R |
| 3,619,405 | 11/1971 | Smith | 208/11 R |
| 3,634,225 | 1/1972 | Garbett | 201/28 X |
| 4,092,237 | 5/1978 | Reed | 208/11 R |
| 4,161,442 | 7/1979 | Auden et al. | 208/11 R |
| 4,297,201 | 10/1981 | Jones et al. | 201/29 X |
| 4,388,174 | 6/1963 | Magedanz et al. | 201/32 X |

*Primary Examiner*—Delbert E. Gantz
*Assistant Examiner*—Glenn A. Caldarola
*Attorney, Agent, or Firm*—Parmelee, Miller, Welsh & Kratz

[57] ABSTRACT

Hot oil depleted shale from an indirect oil shale retorting process is charged into the top of a vertical shaft furnace together with sufficient oxygen to combust the residual carbon in the shale. Recycle process gas is fed into the bottom of the furnace for direct heating by the spent shale. The heated recycle process gas and combustion gases are withdrawn from the furnace separately to minimize dilution of the high BTU process gas. A selected quantity of coarse, cooled spent shale discharged from the bottom of the furnace is recycled to the top to moderate the temperature of combustion.

7 Claims, 1 Drawing Figure

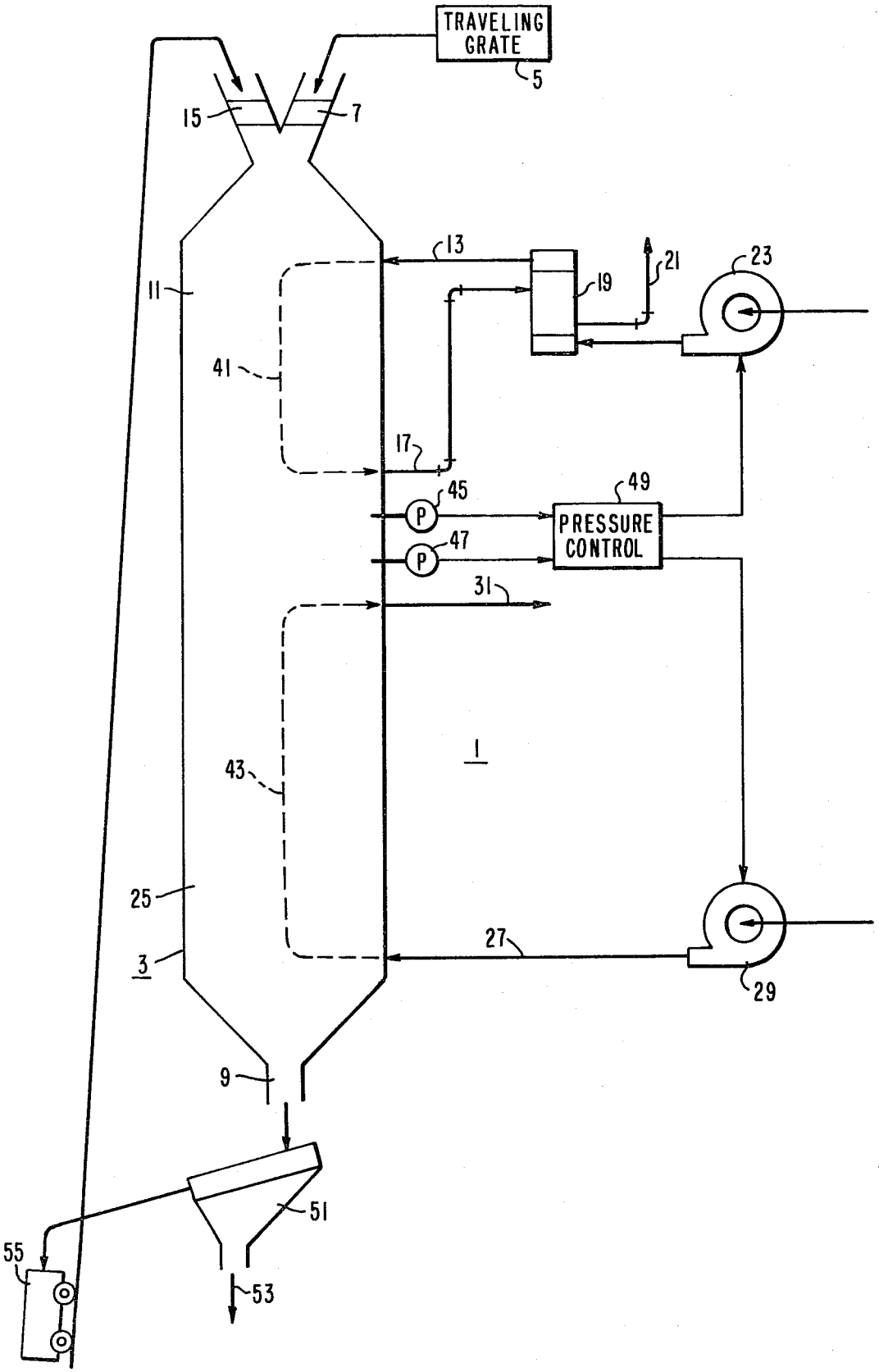
TRAVELING GRATE
5
15
7
13
21
23
19
11
41
17
45
49
P
PRESSURE CONTROL
47
P
31
1
43
25
27
3
29
9
51
55
53

HEATING PROCESS GAS FOR INDIRECT SHALE OIL RETORTING THROUGH THE COMBUSTION OF RESIDUAL CARBON IN OIL DEPLETED SHALE

BACKGROUND OF THE INVENTION

1. Field of the Invention

The invention is directed to the reheating of recycle gas used in indirect retorting of oil shale through the utilization of residual carbon in oil depleted shale and, more particularly, it is directed to a process and an apparatus for improving the thermal efficiency of an indirect oil shale retorting process by burning most of the organic carbon remaining in the oil depleted shale in a separate vertical shaft furnace with the temperature of combustion moderated by the recycling of cooled spent shale.

2. Description of the Prior Art

While there are several methods known by which oil can be recovered from oil bearing shale, it has been found that the use of a traveling grate as the principal processing equipment is preferred. This equipment can be scaled up to a very large commercial size with predictable results and therefore traveling grates, both straight and circular, present a technically and economically feasible method of producing oil from oil shale. The traveling grate may be operated in either of two modes, a direct shale heating mode or an indirect shale heating mode. In the direct mode, air is injected directly into the bed of shale and heat is generated in situ by the combustion of gas and some carbon, and possibly some of the oil from the shale. The exhaust gas from the direct heating process is not of pipeline quality. In addition, most of the organic carbon remains unburned. In the indirect mode of heating the shale, the process gas is heated prior to its contact with the shale and is recirculated through the shale to effect oil liberation and to recover the liberated oil.

In both of these methods, most of the organic carbon produced in the decomposition of the kerogen remains in the shale. In the direct method, the carbon on the surface of the shale is burned but carbon depletion does not extend very far into the shale. This occurs because the burning of the interior carbon depends on the inward diffusion of oxygen in competition with the outward diffusion of carbon monoxide. This is a relatively slow process when compared to the decomposition of shale kerogen. The unburned carbon is left in the shale and the thermal requirements of the retorting process are provided by burning the gas produced in the kerogen decomposition. In the indirect method, none of the carbon is burned and all of the thermal requirements of the retorting process are met by the externally heated process gas.

While the direct heating method has the advantage of a higher oil production rate per unit area of the grate, the indirect heating method renders a higher oil yield and a product gas that is of pipeline quality. The instant invention is directed to a method for the improvement of the thermal efficiency of the indirect heating process.

It has been suggested that the carbon content of spent shale be recovered and utilized in the production of thermal energy. For example, U.S. Pat. No. 2,434,815 teaches a method for the production of steam by combusting the carbon in spent shale in a vertical retort. In U.S. Pat. No. 3,617,466, off-gas from a retort is burned externally to the retort and combustion gases recycled to control the temperature in the retort and prevent clinker formation, U.S. Pat. No. 4,218,304 teaches the combusting of recycle gas outside a retort and the returning of the hot gaseous products to the retort in order to control carbonate decomposition, coking or carbonization of the gas during heating.

In U.S. Pat. No. 4,297,201, the residual carbon in indirectly retorted oil shale is burned out as the retorted shale descends through a vertical kiln separate from the retort vessel. An inert gas is circulated in a closed loop through the kiln to control the temperature and absorb the heat of combustion, and through a heat exchanger which transfers the heat to the process gas for indirect retorting of additional oil shale.

SUMMARY OF THE INVENTION

The present invention is directed to a process and apparatus for burning out the residual carbon in oil depleted shale at a controlled temperature and utilizing the heat energy generated thereby to directly heat recycle gas for retorting additional oil shale without diluting the BTU content of the recycle gas. The hot oil depleted shale from an indirect retort process is charged into the top of a vertical shaft furnace for descending passage therethrough. An oxygen containing gas is fed into the upper portion of the furnace for concurrent downward flow with the hot oil depleted shale to effect combustion of the residual carbon, and with the combustion gases being withdrawn from the lower part of the upper portion of the furnace. The recycle gas is introduced into the bottom of the furnace and flows upwardly, countercurrent to the downward movement of the shale, to heat the gas and cool the shale. The directly heated recycle gas is withdrawn from the furnace below the point where the combustion gases are withdrawn. Mixing of the gases can be minimized by equalizing the gas pressures in this area. The temperature of combustion is moderated by recycling some of the cooled spent shale recovered from the bottom of the furnace to the top.

The withdrawn combustion gases can be cooled by passing them through a heat exchanger which heats the oxygen containing gas before it is fed to the furnace. The cooled combustion gases are then available as a cooled inert gas suitable for uses such as sealing gas for the traveling grate retort. If necessary, the heated recycle gas withdrawn from the furnace can be heated further by passing it through another heat exchanger in which some of the high BTU recycle gas is burned.

The present invention combines the advantage of eliminating the need for the very large heat exchanger required in the completely indirect method of heating recycle gas while preserving the high BTU content of the gas heretofore only possible with the indirect method of recycle gas heating.

BRIEF DESCRIPTION OF THE DRAWING

The above as well as other features and advantages of this invention will become apparent through consideration of the detailed description in connection with the accompanying drawing which schematically illustrates a process and an apparatus utilizing the features of this invention.

DETAILED DESCRIPTION OF THE INVENTION

The invention is illustrated in the drawing where a gas recirculation system for the recovery of thermal energy from spent oil shale is generally indicated by the reference character 1 and includes a vertical shaft furnace 3. The process is described in combination with a traveling grate 5 for the indirect retorting of oil bearing shale. For the purposes of this example, 2000 pounds of raw shale has been used.

After the oil is retorted from the 2000 pounds of fresh shale in the traveling grate 5, the remaining 1813 pounds of hot oil depleted shale are at a maximum temperature of about 1050° F. The hot oil depleted shale is immediately transported to the shaft furnace 3 and charged to the top of the furnace through a conventional air lock 7. The hot oil depleted shale descends through the vertical shaft furnace 3 for discharge at port 9. As the hot oil depleted shale traverses the furnaces, an oxygen containing gas is introduced into the upper region 11 of the furnace 3 through the line 13 in order to effect combustion of the carbon contained in the oil depleted shale. Approximately 4700 SCF of air satisfies the stoichiometric requirements for combustion. It should be appreciated that the utilization of the process of this invention provides the collateral benefit of significantly increasing the potential retorting capacity of the traveling grate machine because the spent shale cooling zone is eliminated.

The temperature of the oil depleted shale during residual carbon combustion in the vertical shaft furnace 3 must be controlled to prevent the decomposition of the calcium and magnesium carbonates in the shale. The endothermic reaction resulting from the aforementioned decomposition would cause a significant energy loss in this energy recovery process. Accordingly, it is preferred that the temperature of combustion be limited to about 1300° F.

The residual carbon combustion temperature is controlled by the introduction of an inert material into the vertical shaft furnace 3 to absorb excess heat. Combusted spent shale which has been cooled to about 200° F. in a manner to be hereinafter described, is transported from the discharge port 9 of the furnace to the top of the furnace 3 where it is charged into the furnace through a conventional air lock 15. The cooled, combusted spent shale combines with the hot oil depleted shale in the upper region 11 of the furnace and moderates the combustion process to keep the combustion temperature below about 1300° F. Combustion gas at about 1200° F. is recovered from the furnace 3 through line 17 which directs the 7400 SCF of gaseous products of combustion to heat exchanger means 19. The oxygen containing gas supplied to the furnace through line 11 can be preheated from about 77° F. to about 1085° F. in the heat exchanger 19, while the inert combustion gas is cooled to about 200° F. for transfer through line 21 to the traveling grate 5. This cooled inert gas can be used for the seals in the traveling grate. The oxygen containing gas is forced through the heat exchanger 19 and into the furnace 3 by a blower 23.

In the lower region 25 of the furnace 3, the thermal energy contained in the combusted spent shale and the inert spent shale utilized for temperature control is recovered through countercurrent contact by recycle process gas. The recycle process gas is conveyed from the grate 5 to the furnace through line 27 by means of a blower 29. Approximately 31300 SCF of recycle process gas is heated from about 120° F. to 1200° F. as it passes up through the lower region 25 of the furnace. This heated recycle process gas is withdrawn through line 31 which is located below the line 17 through which the combustion gases are withdrawn from the furnace and is returned to the grate 5 for processing fresh shale.

As indicated in the drawing at 41, the products of combustion circulate in the upper region or first zone 11 of the furnace 3 and the heated process gas is passed through the lower region or second zone 25 of the furnace as indicated at 43. Mixing of these gases is minimized by maintaining equal pressure at the interface between the first and second zones through control of the blowers 23 and 29. Pressure sensors 45 and 47 measure the pressure in the lower portion of the upper zone and the upper portion of the lower zone respectively of the furnace. Control means 49 monitors these pressures and regulates the blowers 23 and 29 to drive the pressure differential toward zero. This arrangement permits the recycle process gas to be heated directly, which is thermally and economically more efficient, without diluting the high BTU content of the gas.

About 3630 pounds of recycled spent shale and combusted spent shale are discharged from the furnace 3 through the port 9. The spent shale is screened by a sizing means 51 so that shale fines are discharged for further disposal as at 53 while the coarse spent shale is discharged into recirculation means 55. The coarse spent shale is discharged at a temperature of about 250° F. and about 1870 pounds thereof are required to effect combustion temperature control. For the purpose of this invention, the term coarse spent shale is used to describe shale that will pass through a one inch screen. The utilization of only the coarser spent shale makes the bed of shale descending through the furnace more permeable to the flow of gas therethrough in both the upper and lower zones.

While a single embodiment of the invention has been described in detail, the specifics of that detailed description are not meant to be limiting and the invention is to be interpreted in terms of the accompanying claims including any and all equivalents thereof.

What is claimed is:

1. A process for reheating recycle gas used in indirect retorting of oil from oil shale and from which the oil has been removed, utilizing the residual carbon in hot oil depleted shale said method comprising the steps of:

charging hot oil depleted shale containing residual carbon into the top of a vertical shaft furnace for descending passage therethrough;

feeding an oxygen containing gas into the upper portion of said furnace for concurrent downward flow with the hot shale to effect combustion of the residual carbon therein in the upper portions of said vertical shaft furnace and resulting in the generation of hot spent shale and combustion gases;

withdrawing the combustion gases from the lower part of the upper portion of said furnace;

introducing said recycle gas into the bottom of the vertical shaft furnace for ascending flow countercurrent to the descending flow of the hot spent shale to heat said recycle gas and cool said spent shale;

withdrawing the heated recycle gas from the upper part of the lower portion of the furnace below the point at which the downwardly flowing combustion gases are withdrawn, for use in retorting additional oil shale;

removing the cooled spent shale from the bottom of the vertical shaft furnace; and recycling a portion of the cooled spent shale to the top of the vertical shaft furnace to control the temperature of combustion of the residual carbon in the hot oil depleted shale charged into said furnace.

2. The process of claim 1 wherein the pressures in the lower part of the upper portion and the upper part of the lower portion of the vertical shaft furnace are maintained about equal in order to minimize mixing between the combustion gases and the heated recycle gas.

3. The process of claim 1 wherein the combustion gases withdrawn from the furnace are used to heat the oxygen containing gas before it is fed into the furnace.

4. The process of claim 1 wherein the cooled spent shale is screened prior to its re-entry into the furnace so that only the coarse fraction of material is recycled whereby the permeability of the combined burden of hot oil depleted shale and cooled spent shale is enhanced.

5. The process of claim 1 wherein the temperature of combustion is limited to about 1300° F. by the recycling of the cooled spent shale.

6. The process of claim 1 wherein the heated recycle gas withdrawn from the upper part of the lower portion of the furnace is further heated prior to being reused to retort fresh oil shale.

7. The process of claim 6 wherein the heated recycle gas is further heated by the combustion of additional recycle gas by transferring the heat of combustion therefrom to the heated recycle gas in heat exchange means.

* * * * *